US008739413B2

(12) United States Patent
Huett

(10) Patent No.: US 8,739,413 B2
(45) Date of Patent: Jun. 3, 2014

(54) PACKAGE OPENER SYSTEM

(76) Inventor: James C. Huett, Fort Collins, CO (US)

( * ) Notice: Subject to any disclaimer, the term of this patent is extended or adjusted under 35 U.S.C. 154(b) by 245 days.

(21) Appl. No.: 12/655,009

(22) Filed: Dec. 21, 2009

(65) Prior Publication Data

US 2010/0154219 A1 Jun. 24, 2010

Related U.S. Application Data

(60) Provisional application No. 61/203,541, filed on Dec. 23, 2008.

(51) Int. Cl.
*B67B 7/78* (2006.01)

(52) U.S. Cl.
USPC ..... 30/136; 30/280; 30/314; 30/169

(58) Field of Classification Search
USPC ..... 30/2, 136, 142, 314, 315, 317, 287, 30/299, 169, 172, DIG. 3; 7/110, 113, 158, 7/160, 165; D8/102–104; 294/6–8; 15/245, 236.01, 236.07; D28/7; D7/395, 688
See application file for complete search history.

(56) References Cited

U.S. PATENT DOCUMENTS 127,229 A * 5/1872 Fasig ..... 30/314
233,161 A * 10/1880 Muckle ..... 30/DIG. 3
518,223 A * 4/1894 Cahen ..... 30/299
D33,679 S * 12/1900 Sommer ..... D8/102
776,938 A * 12/1904 Rebhan ..... 30/142
838,852 A * 12/1906 Eckley ..... 30/287
853,367 A * 5/1907 Malory ..... 30/314
866,308 A * 9/1907 Sanders ..... 30/317
1,041,767 A * 10/1912 Frank ..... 30/299
D44,646 S * 9/1913 Thomson ..... 30/168
D44,934 S * 11/1913 Peterson ..... D8/102
D48,124 S * 11/1915 Pleister ..... D8/102
D65,916 S * 11/1924 Kortick ..... D8/103
1,541,088 A * 6/1925 Whitenack ..... 15/245
1,589,683 A * 6/1926 Clinger ..... 30/2
2,039,850 A * 5/1936 Silaj ..... 30/299
2,065,886 A * 12/1936 Clift ..... 15/245
D102,995 S * 2/1937 Stewart ..... D8/102
D115,310 S * 6/1939 Dellinger ..... D8/102
2,248,140 A * 7/1941 Trollen ..... 30/342
2,391,247 A * 12/1945 Knudtson ..... 30/2
D147,593 S * 9/1947 Lipic ..... D8/102
2,439,639 A * 4/1948 Tilly ..... 30/DIG. 3
D149,590 S * 5/1948 Schlegel ..... D8/103
D156,056 S * 11/1949 Vander Kuy ..... D8/102
2,487,291 A * 11/1949 Abruzzese ..... 30/169
D165,056 S * 11/1951 Day, Jr. ..... D8/102
2,671,668 A * 3/1954 Krause et al. ..... 30/342
2,674,005 A * 4/1954 Simon ..... 30/169
2,681,506 A * 6/1954 Tipple ..... 30/299
D178,437 S * 7/1956 Walborn ..... D8/102
D183,641 S * 9/1958 Werstein ..... D8/102
D184,576 S * 3/1959 Pancari ..... D8/103

(Continued)

*Primary Examiner* — Jason Daniel Prone
(74) *Attorney, Agent, or Firm* — Craig R. Miles; CR Miles P.C.

(57) ABSTRACT

Generally, a box opener system which provides in a single device a configuration to generate the open condition of numerous and varied types of boxes. Specifically, a cutter element in a handle disposed between a blade element and an impact element which can be used to disengage the sealed outer flaps or the side wall between perforations or cut box liners to generate the open condition of a box.

5 Claims, 5 Drawing Sheets

(56) References Cited

U.S. PATENT DOCUMENTS

| | | | | | |
|---|---|---|---|---|---|
| 2,900,656 | A | * | 8/1959 | Tupper | 15/245 |
| 2,906,021 | A | * | 9/1959 | Cromoga | 30/293 |
| 3,009,248 | A | * | 11/1961 | Tilly | D8/102 |
| D199,861 | S | * | 12/1964 | Eicher et al. | 30/142 |
| D215,041 | S | * | 8/1969 | Laughlin | D8/102 |
| 3,613,134 | A | * | 10/1971 | Bassett | 30/2 |
| 3,761,976 | A | * | 10/1973 | D'Amico | 7/163 |
| 3,774,252 | A | * | 11/1973 | Cantales | 7/158 |
| 3,791,033 | A | * | 2/1974 | Regan | 30/287 |
| 3,883,952 | A | * | 5/1975 | Strovas | 30/299 |
| 3,918,158 | A | * | 11/1975 | Debski | 30/314 |
| 4,198,751 | A | * | 4/1980 | Egbert | 30/317 |
| D256,329 | S | * | 8/1980 | Murtagh | D8/103 |
| 4,316,324 | A | * | 2/1982 | Cochran | 30/287 |
| 4,387,510 | A | * | 6/1983 | Hashemifard | 30/314 |
| D275,166 | S | * | 8/1984 | Laslo | D8/102 |
| D286,576 | S | * | 11/1986 | Schneider et al. | D28/7 |
| 4,631,829 | A | * | 12/1986 | Schmidt et al. | 30/2 |
| 4,646,437 | A | * | 3/1987 | Blomqvist | 30/317 |
| D292,867 | S | * | 11/1987 | Hölterscheidt | D8/102 |
| 5,251,351 | A | * | 10/1993 | Klotz | 7/158 |
| 5,282,316 | A | * | 2/1994 | Anderson | 30/2 |
| 5,347,719 | A | * | 9/1994 | Scharf | 30/315 |
| D365,163 | S | * | 12/1995 | Brogliato | D26/38 |
| 5,491,869 | A | * | 2/1996 | Sullivan et al. | 15/245 |
| 5,513,405 | A | * | 5/1996 | Bradbury et al. | 7/158 |
| 5,542,139 | A | * | 8/1996 | Boivin | 7/118 |
| 5,630,242 | A | * | 5/1997 | Oginaezawa | 30/294 |
| 5,720,062 | A | * | 2/1998 | Vaught | 30/DIG. 3 |
| 5,720,063 | A | * | 2/1998 | Chacon | 7/165 |
| D393,776 | S | * | 4/1998 | Kessler | D8/107 |
| D407,599 | S | * | 4/1999 | Mohrhauser et al. | D7/688 |
| 5,890,290 | A | * | 4/1999 | Davis | 30/2 |
| 5,899,372 | A | * | 5/1999 | Rodriguez | 30/2 |
| 5,903,942 | A | * | 5/1999 | Hasegawa | 30/158 |
| 6,163,910 | A | * | 12/2000 | Cheldin | 7/158 |
| D436,810 | S | * | 1/2001 | Slater | D7/688 |
| D438,440 | S | * | 3/2001 | Cheldin | D8/102 |
| 6,314,644 | B1 | * | 11/2001 | Raeker | 30/2 |
| D452,632 | S | * | 1/2002 | Prince et al. | D7/395 |
| 6,453,564 | B1 | * | 9/2002 | Foley | 7/158 |
| D473,762 | S | * | 4/2003 | Kerr | D7/688 |
| 6,574,816 | B2 | * | 6/2003 | Yu Chen | 7/100 |
| D477,191 | S | * | 7/2003 | Bull et al. | D7/688 |
| 6,619,013 | B2 | * | 9/2003 | Dismukes | 30/2 |
| D481,270 | S | * | 10/2003 | Siegel et al. | D7/688 |
| 6,662,521 | B1 | * | 12/2003 | Escobedo et al. | 7/165 |
| 6,769,147 | B1 | * | 8/2004 | Stubbs | 7/165 |
| 6,857,192 | B1 | * | 2/2005 | Summers et al. | 30/299 |
| D512,625 | S | * | 12/2005 | Cheldin | D8/102 |
| D527,944 | S | * | 9/2006 | Brooks | D7/393 |
| 7,182,377 | B2 | * | 2/2007 | Grundler | 294/7 |
| 7,185,385 | B2 | * | 3/2007 | Kohler | 15/245 |
| D541,599 | S | * | 5/2007 | Quattromani | D7/688 |
| D616,713 | S | * | 6/2010 | Jossem | D7/688 |
| D618,521 | S | * | 6/2010 | Jalet et al. | D7/688 |
| D621,678 | S | * | 8/2010 | Huang | D8/104 |
| D628,447 | S | * | 12/2010 | Genatossio et al. | D7/688 |
| D673,820 | S | * | 1/2013 | Batchelder | D7/688 |
| D677,532 | S | * | 3/2013 | Joseph | D7/688 |
| 2002/0069733 | A1 | * | 6/2002 | Allenberg et al. | 30/294 |
| 2002/0078572 | A1 | * | 6/2002 | Linton et al. | 30/317 |
| 2003/0061665 | A1 | * | 4/2003 | Chen | 7/100 |
| 2003/0213133 | A1 | * | 11/2003 | Hanna | 30/294 |
| 2004/0231058 | A1 | * | 11/2004 | Stubbs | 30/169 |
| 2005/0102844 | A1 | * | 5/2005 | Addis | 30/299 |
| 2006/0064822 | A1 | * | 3/2006 | Wang | 7/144 |
| 2007/0031177 | A1 | * | 2/2007 | Haas | 401/195 |
| 2010/0101028 | A1 | * | 4/2010 | Cheldin | 7/165 |
| 2011/0191975 | A1 | * | 8/2011 | Genatossio et al. | 15/245.1 |

* cited by examiner

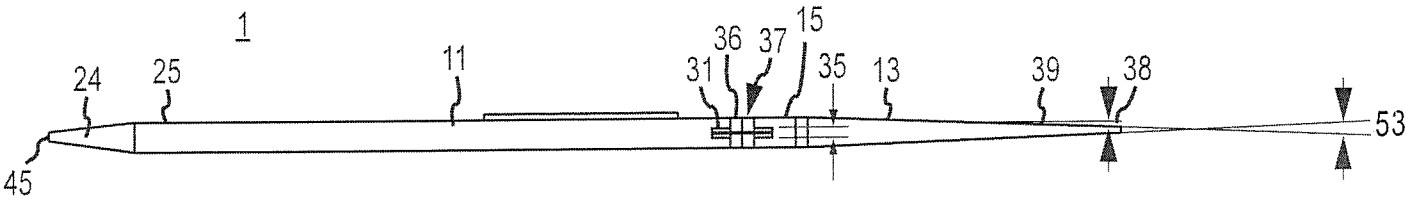
FIG.4
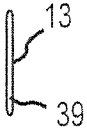
FIG.7
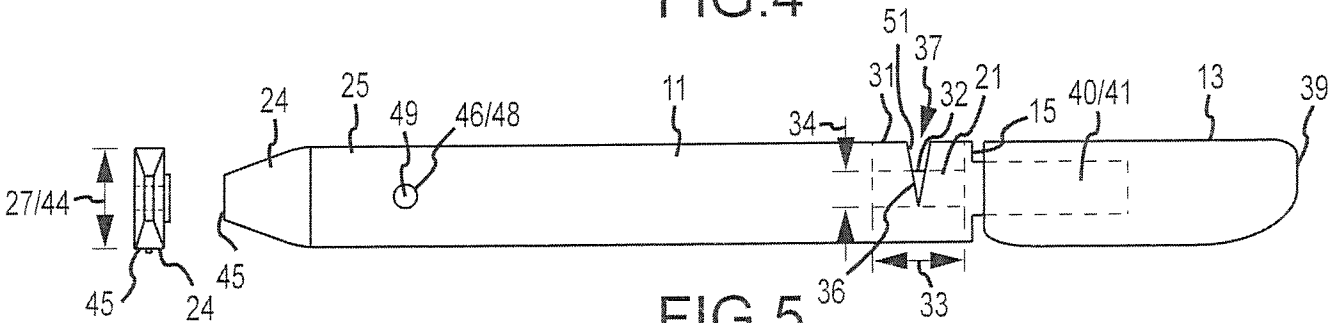
FIG.5
FIG.8
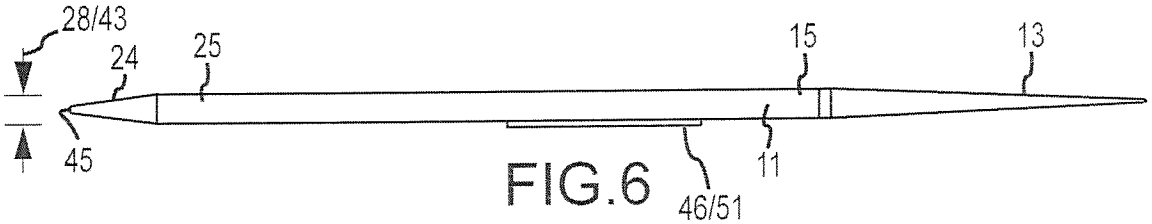
FIG.6

PACKAGE OPENER SYSTEM

This United States patent application claims the benefit of U.S. Provisional Patent Application No. 61/203,541, filed Dec. 23, 2008, hereby incorporated by reference herein.

I. BACKGROUND

Generally, a box opener system which provides in a single device a configuration to generate the open condition of numerous and varied types of boxes. Specifically, a cutter element in a handle disposed between a blade element and an impact element which can be used to disengage the sealed outer flaps or the side wall between perforations or cut box liners to generate the open condition of a box.

A significant problem with opening conventional boxes can be that the manner of sealing and lining the box can require use of a plurality of devices to unseal the outer flaps or tear the box between perforations or generate an opening in the box liner (or all in various permutations and combinations) to allow ingress to the packaged materials or egress of the packaged materials from the box.

Another significant problem with opening of conventional boxes can be that the plurality of devices used to unseal the outer flaps or tear the box between perforations or generate an opening in the box liner can include edges sufficiently sharp to impale or cut the skin or tissue of the user.

Another significant problem with opening of conventional boxes can be that materials used to construct the box and the box liner can be resistant to convention methods used to open boxes. For example, certain box liners may not be opened by conventional grippable engagement and tearing movement of the hands because the materials used in box liners are purposefully made to be tear resistant and may have a surface which does not afford sufficient grip to use a tearing movement sufficiently forceful to tear the liner material. Also, box liners may be fixedly engaged to the side walls of the box and further sealed in a fashion which obstructs use of conventional cutting tools such as scissors. As yet another example, the materials used in the side walls of boxes are often readily impaled but resist tearing between perforations. As yet another example, the outer flaps of boxes may be sealed with a layer of adhesive which does not readily cut but must be separated by wedged or levered engagement.

The invention described herein addresses the problems associated with conventional apparatuses and methods for box opening.

II. SUMMARY OF THE INVENTION

Accordingly, a broad object of the invention can be to provide in a single device a box opener system configured to generate the open condition of numerous and varied types of boxes.

Another broad object of the invention can be to provide a cutter to cut cuttable materials, a blade having a taper sufficient to disengage sealed outer flaps and an impact element configured to tear the box wall between perforations without also affording cutting, blade, or impact surfaces which can impale or cut the user during normal use to open boxes.

Another broad object of the invention can be to provide a cutter, a blade and an impact element configured to act more effectively upon the materials and liners from which boxes are made to produce the open condition of the box.

Naturally, further objects of the invention are disclosed throughout other areas of the specification, drawings, photographs, and claims.

III. A BRIEF DESCRIPTION OF THE DRAWINGS

FIG. 4 is a first side view of a particular embodiment of the invention.

FIG. 5 is a top view of a particular embodiment of the invention.

FIG. 6 is a second side view of a particular embodiment of the invention.

FIG. 7 is a first end view of a particular embodiment of the invention.

FIG. 8 is a second end view of a particular embodiment of the invention.

IV. DETAILED DESCRIPTION OF THE PREFERRED EMBODIMENTS

Generally, a box opener system which provides in a single device a configuration to generate the open condition of numerous and varied types of boxes. Specifically, a cutter element in a handle disposed between a blade element and an impact element which can be used to disengage the sealed outer flaps or the side wall between perforations or cut box liners to generate the open condition of a box.

Figure 1:
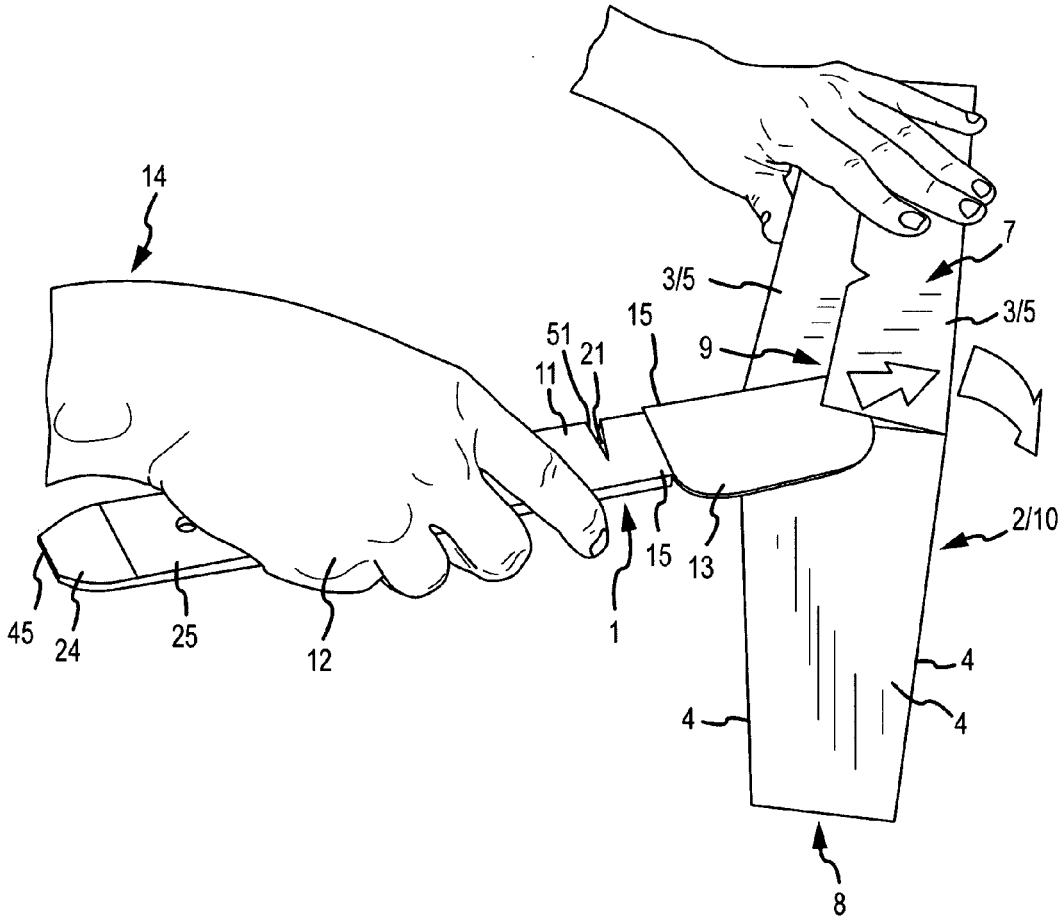
FIG. 1 is an illustration of how to use a particular embodiment of the invention to open the sealed outer flaps of a box.
Figure 2:
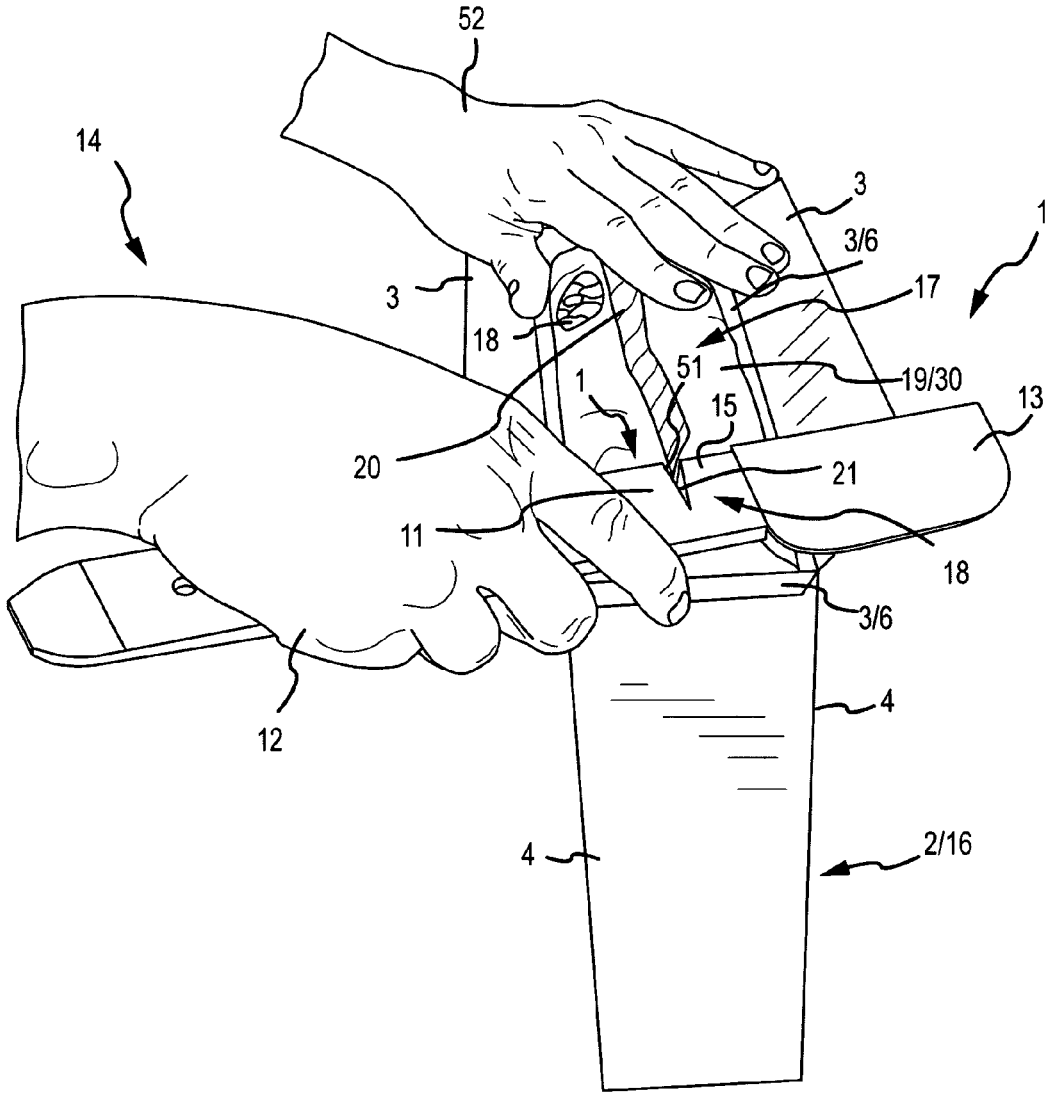
FIG. 2 is an illustration of how to use a particular embodiment of the invention to open a box liner.

Now referring primarily to FIGS. 1 and 2, a particular method of using the box opener system (1) is shown. A conventional box (2) can provide four flaps (3) one extending from each of four side walls (4) or one extending from each end of each of four side walls (4). The outer flaps (5) sealably overlie the inner flaps (6) to provide a box top (7) and a box bottom (8). A seal (9) between the outer flaps (5) can be provided by encircling the box (2) with a band, applying tape, staples, or a layer of adhesive to the overlappingly engaged surfaces, or the like, to generate the closed condition (10) of the box (2) as shown in FIG. 1. The particular construction of a box (2) above-described is not intended to be limiting with respect to the numerous and wide variety constructional forms of a box (2) which can be opened utilizing the box opener system (1). A box (2) can have any number of side walls (4) such as three, four, five, six, or more side walls (4) all or some of which may provide a corresponding flaps (3) which can sealably overlie to provide the closed condition (10) of the box (2).

Again referring primarily to FIGS. 1 and 2, an embodiment of the box opener system (1) can provide an elongate member (11) (also referred to as "a handle") a portion of the external surface configured to be grippably engaged or received in a first hand (12) of a user (14) (also referred to as "a person"). In those instances, in which the overlapped portions of outer flaps (5) of the box (2) have a seal (9) in the form of a layer of adhesive, staples, tape, or a combination of these seal materials, a blade (13) extending axially outward from a first handle end (15) can be forcibly urged between the sealably engaged outer flaps (5) (or sealably engaged inner flaps (6) or both) of the box (2). The blade (13) can be drawn between the sealed outer flaps (5) of the box (2) a distance sufficient to disengage the sealed outer flaps (5) to generate the open condition (16) of the box (2) as shown in FIG. 2.

Now referring primarily to FIG. 2, a box (2) can further provide a box liner (17) configured to enclosed an amount of packaged material (18). One non-limiting example of a box liner (17) provides a flexible liner wall (19) in the form of a conduit having length deposed between a pair of sealed liner ends (20). One of the pair of sealed liner ends (20) can have a location proximate the sealed outer flaps (5) in the closed condition (10) of the box (2). Upon disengaging the sealed outer flaps (5), a corresponding one of the pair of sealed liner ends (20) can be gripped by a second hand (52) of a user (14). The box opener system (1) can further provide a cutter element (21) disposed in the handle (11) of the box opener system (1) which can be engaged with the box liner (17) at location below one of the pair of sealed liner ends (20). The cutter element (21) can be forcibly urged against the box liner (17) to excise a portion of or all of the engaged one of the pair of sealed liner ends (20) to provide access to the amount of packaged material (18) inside of the box liner (17). In those embodiments of the box (2) which seal the overlapped outer flaps (5) with a flexible band, the cutter element (21) can be cuttingly engaged with the flexible band to disengage the outer flaps (5) to produce the open condition (16) of the box (2).

Figure 3:
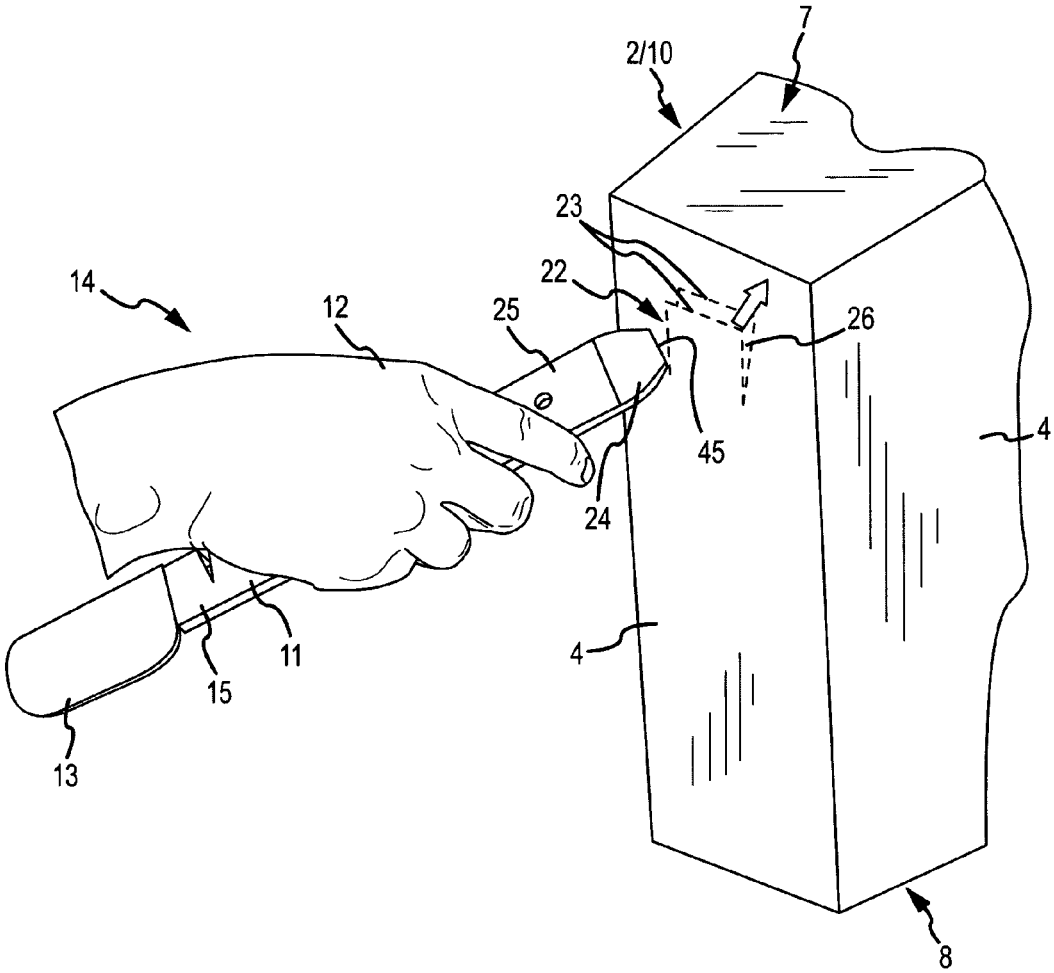
FIG. 3 is an illustration of how to use a particular embodiment of the invention to tear the side wall of a box between a plurality of perforations.

Now referring primarily to FIG. 3, another type of conventional box (2) includes a perforated seal (22) which provides a plurality of perforations (23) between the external surface and the internal surface of one or more side walls (4) of the box (2) (or sufficiently through one of the side walls (4) to allow tearing between partial perforations). Forcible urging or impact proximate the plurality of perforations (23) allows the corresponding one of the side walls (4) of the box (2) to tear between some or all of the plurality of perforations (23) to allow ingress to the interior of the box (2) or egress of the packaged material (18) from the box (2). An impact element (24) extending axially outward from a second handle end (25) can be forcibly engaged to one of the side walls (4) of the box (2) proximate the perforated seal (22)) to tear the box (2) between some or all of the plurality of perforations (23) to generate an access opening (26) in the engaged one of the side walls (4) of the box (2) to allow ingress to the interior of the box (2) or to all egress of the packaged material (18) from the box (2).

By utilizing one or more of the methods or steps above-described in various permutations and combinations with an embodiment of the box opener system (1) further described below a numerous and wide variety of boxes (2) can be opened without having to use a plurality of conventional devices.

Figure 9:
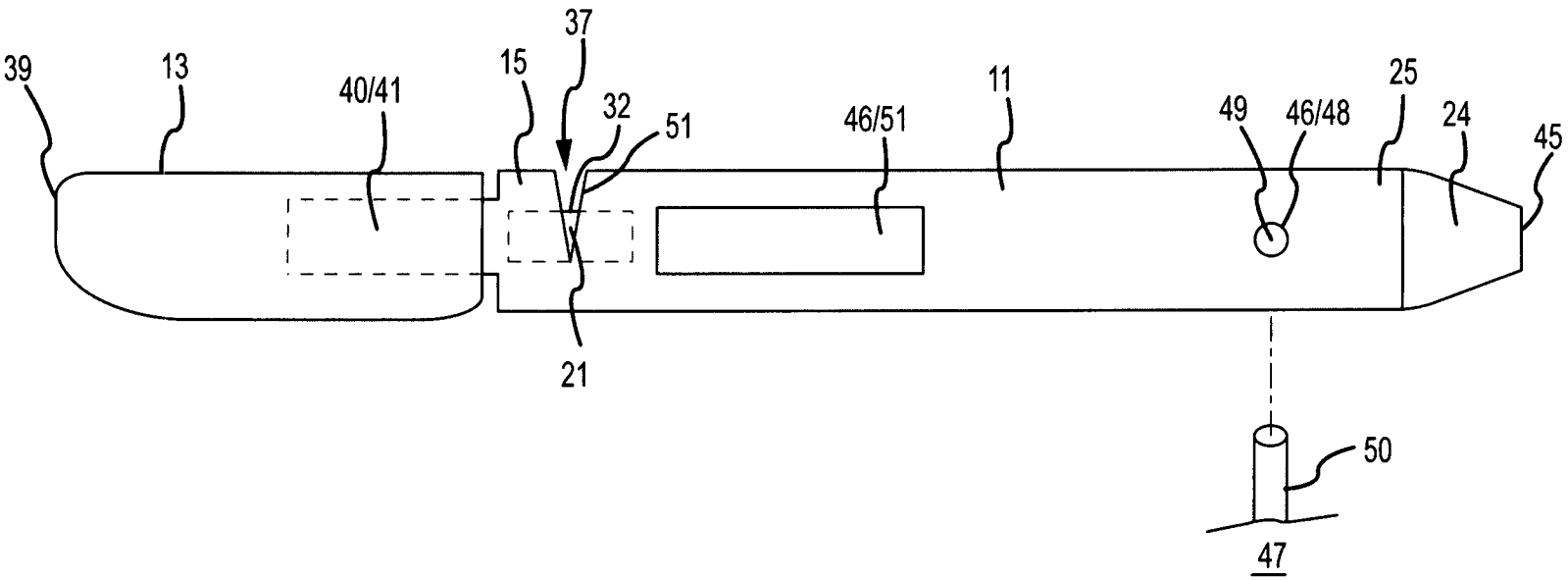
FIG. 9 is a bottom view of a particular embodiment of the invention.

Now referring primarily to FIGS. 4-9, embodiments of the box opener system (1) can include a handle (11) configured to be grippably received by the first hand (12) of a user (14). As shown by FIGS. 4, 5 and 9, the handle (11) can be configured as a rectangular elongate member having a handle width (27) in the range of about three-quarters inch and about one and one-half inch and a handle height (28) in the range of about one-eighth inch and about three-quarters inch. However, the dimensional relations of the handle (11) could be of a lesser or greater range or have any manner of configuration for example oval, square, triangular, round, or other configuration so long as a portion of the handle (11) can be received and sufficiently gripped by the first hand (12) of a user (14) to be used in accordance with the methods above-described.

Again referring primarily to FIGS. 4, 5, and 9, embodiments of the box opener system (1) can further include a cutter element (21) coupled to the handle (11). The cutter element (21) will typically be coupled to the handle (11) proximate to the first handle end (15) or the second handle end (25) or at least sufficiently close to the first handle end (15) or the second handle end (25) such that the handle (11) can be grippingly received by the first hand (12) of a user (14) with the cutter element (21) located a sufficient distance outward from the first hand (12) to engage a cuttable material (30) such as a band which seals the outer flaps (5) of a box (2), a box liner (17), or the like. The cutter element (21) can be coupled to the handle (11) by way of mechanical fasteners such as rivets, spirally threaded screws, adhesive, or can be slidably inserted in a cutter receiving element (31) of the handle (11), or can be coupled to the handle (11) by location in a mold which receives an amount of handle material which cures about the cutter element (21) to fixedly couple the cutter element (21) to the handle (11). The cutter element (21) can further include a cutter edge (32) capable of cutting a cuttable material (30) of a box (2).

The non-limiting embodiment of the handle (11) shown in FIG. 5, provides a cutter receiving element (31) configured to receive a part of the cutter element (21). The cutter element (21) shown in the non-limiting example of FIG. 5 has a substantially flat rectangular configuration having a cutter length (33) in the range of about one-half inch to about one inch and a cutter width (34) in the range of about one eighth and about one-half inch with a cutter thickness (35) in the range of one-thirty second of an inch and about one-sixteenth of an inch. The cutter receiving element (31) can be correspondingly configured as a slot having a slot length, a slot width and a slot depth which allows the substantially flat rectangular configuration of the cutter element (21) above-described to insertingly engage the handle (11). The cutter receiving element (31) can be configured to sufficiently engage the cutter element (21) upon insertion to retain the cutter element (21) in the cutter receiving element (31) of the handle (11) during normal use. Certain embodiments of the cutter receiving element (31) can have sufficient depth to allow the cutter edge (32) of the cutter element (31) to be recessed a distance below the external surface of the handle (11), as shown in the non-limiting example of FIGS. 5 and 9. In those embodiments of the handle (11) in which the cutter element (21) has been recessed a distance below the external surface of the handle (11), the handle (11) further provides an indentation element (36) which provides an cutter open space (37) in which a part or all of the cutter edge (32) of the cutter element (31) can be sufficiently exposed to allow engagement of a cuttable material (30) with the cutter edge (32). The indentation element (36) of the handle (11) can be configured to provide a cutter open space (37) which at the external surface of the handle (11) has greater width than at the cutter edge (32) to provide a cutter open space (37) which narrows approaching the cutter edge (32) but has sufficient width at the cutter edge (32) to allow cutting engagement of a cuttable material (30) with the cutter edge (32). The configuration of the cutter element (21) is not limited to a flat rectangular configuration shown in the Figures and can be any configuration which can be coupled to the handle (11) and provides a cutter edge (32) useful in cutting cuttable material (30) of a box (2). While the cutter open space (37) shown in FIG. 5 has a triangular or truncated triangular boundary, the invention is not so limited and the cutter open space (37) can provide a cuttable material guide (51) having surfaces with define a triangular boundary, a rectangular boundary, a circular boundary, an oval boundary, or other boundary configuration which correspondingly defines the cutter open space (37) in which cuttable material (30) of a box (2) or a box liner (17) or band which encircles a box (2) are locatable to be engaged with the cutter edge (32).

Again referring primarily to FIGS. 4-9, embodiments of the box opener system (1) can further include a blade (13) extending axially outward from a first handle end (15). Embodiments of the blade (13) can have a blade thickness (38) greater proximate the first handle end (15) than at the blade terminal (39), as shown for example in FIG. 7. The thickness at the blade terminal (39) can be sufficiently thin to be inserted by forcible urging between the overlapped outer flaps (5) of a box (2) a sufficient distance to disengage the sealed outer flaps (5) to allow the open condition (16) of the box (2). As one non-limiting example, the embodiment of the blade (13) shown in FIG. 5, has a blade thickness (38) in the range of about three sixteenths inch and one eighth inch proximate the first handle end (15) and a thickness in the range of about one-thirty second inch and about one-sixteenth inch at the blade terminal (39). The taper of the blade (13) extending from the blade terminal (39) toward the first handle end (15) provides a blade angle (53) in the range of about five degrees and about ten degrees as shown in FIG. 4. The blade terminal (39) can be sufficiently hebetated to avoid impalement or cutting of the skin or tissue of the user (14) during normal use in opening a box (2). Embodiments of the blade (13) can have a length of in the range of about one inch and about three inches and a width of about one-half to about one and one half inches. The blade (13) can be coupled to the first handle end (15) by use of mechanical hardware such as rivets or spirally threaded screws, adhesive, a tenon (40) insertably engaged in a socket (41) as shown in FIG. 5, or the like. The handle (11) and blade (15) can also be fabricated, molded or otherwise produced as one piece.

Again referring primarily to FIGS. 4-9, embodiments of the box opener system (1) can further include an impact element (24) extending axially outward from a second handle end (25) (also referred to as the "second elongate member end"), as shown for example in FIGS. 5 and 8. Embodiments of the impact element (24) can have an impact element thickness (43) and an impact element width (44) greater proximate the second handle end (25) than at the impact element terminal (45), as shown for example in FIG. 8. The thickness and width of the impact element (24) at the impact element terminal (45) can be sufficient thin and narrow that upon forcible impact with the plurality of perforations (23) between the external surface and the internal surface of the side walls (4) of a box (2), the corresponding one of the side walls (4) of the box (2) will tear between some or all of the plurality of perforations (23) to allow ingress to the interior of the box (2) or egress of the packaged material (18) from the box (2). However, the thickness and width of the impact element (24) at the impact element terminal (45) can be adjusted in relation to the type of material used in the side walls (4) of the box (2) and the manner of providing the plurality of perforations (23) in the material used in the side walls (4) of the box (2) to avoid interpenetration of the corresponding one of the side walls (4) of the box (2) having the perforated seal (22) by other than tearing of the corresponding one of the side walls (4) of the box (2) between a part of the plurality of perforations (23). The impact element terminal (45) can be of any configuration which in normal use achieves tearing of the perforated seal (22) between a part of the plurality of perforations (23) and the particular embodiment of the impact element (24) shown in FIGS. 4-9 is not intended to be limiting with respect to the numerous and varied configurations of the impact element (24) which can be used in the box opener system (1).

Now referring primarily to FIGS. 5 and 9, the box opener system (1) can further include a hang element (46) which functions to allow the box opener system (1) to be located in relation to a certain support surface (47). As shown as a non-limiting example, the box opener system (1) can further include a hang element (46) in the form of an aperture element (48) which provides an aperture (49) which communicates between opposed external surfaces of the handle (11). An elongate member (50) projecting outwardly from a support surface (47) can pass through the aperture (49) to allow hanging securement of the box opener system (1). Another non-limiting example of a hang element (46) can provide a magnet (51) coupled to the external surface of the box opener system which allows magnetic securement of the box opener system (1) with certain types of the support surface (47).

As can be easily understood from the foregoing, the basic concepts of the present invention may be embodied in a variety of ways. The invention involves numerous and varied embodiments of a box opener and a correspondingly numerous and varied methods of opening boxes.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of "box opener" should be understood to encompass disclosure of the act of "opening a box"—whether explicitly discussed or not—and, conversely, were there effectively disclosure of the act of "opening a box", such a disclosure should be understood to encompass disclosure of "a box opener" and even a "means for opening a box." Such alternative terms for each element or step are to be understood to be explicitly included in the description.

In addition, as to each term used it should be understood that unless its utilization in this application is inconsistent with such interpretation, common dictionary definitions should be understood to included in the description for each term as contained in the Random House Webster's Unabridged Dictionary, second edition, each definition hereby incorporated by reference.

For the purposes of the present invention, ranges may be expressed herein as from "about" one particular value to "about" another particular value. When such a range is expressed, another embodiment includes from the one particular value to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint.

Moreover, for the purposes of the present invention, the term "a" or "an" entity refers to one or more of that entity; for example, "a member" refers to one or more member(s) or at least one member. As such, the terms "a" or "an", "one or more" and "at least one" can be used interchangeably herein.

For the purpose of the present invention, certain terms relating the parts of human body may be used in the claims for the purposes of further limiting or clarifying the structure of configuration of certain elements. Such use is not intended to claim a human or any part of a human.

Thus, the applicant(s) should be understood to claim at least: i) a box opener as herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

The claims set forth in this specification, if any, are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

The invention claimed is:

1. A box opener comprising:

a substantially rectangular elongate member having an elongate member first end and an elongate member second end, said substantially rectangular elongate member having an external surface having a portion of said external surface configured for grippable engagement by a hand of a person;

a substantially rectangular blade element having a blade first end connected to said elongate member first end, said blade element only connected to said elongate member first end, said blade element having a blade width substantially equal to a width of said substantially rectangular elongate member, said blade element having a longitudinal axis substantially collinear with a longitudinal axis of said elongate member, and said blade element having a tapered hebetated second end;

said elongate member second end defining an impact element;

a recess in said external surface of said elongate member between said blade element and said impact element;

a hold space inside said substantially rectangular elongate member, a portion of said hold space in communication with said recess;

a cutter element having a cutter edge, wherein said hold space holds said cutter element to recess an entirety of said cutter edge a distance below said external surface of said substantially rectangular elongate member and with a portion of said cutter edge in the portion of said hold space exposed within said recess to allow said cutting edge to perform a cutting function.

2. The box opener of claim 1, wherein said recess has tapered sides which angle toward one another approaching said cutter edge of said cutter element.

3. The box opener of claim 1, wherein said impact element tapers to a substantially rectangular end surface with a width that is smaller than said width of said substantially rectangular elongate member.

4. The box opener of claim 1, further comprising a magnet attached to said external surface of said substantially rectangular elongate member.

5. The box opener of claim 1, further comprising an aperture extending through said substantially rectangular elongate member.

* * * * *